United States Patent [19]

Cecil, deceased

[11] 4,034,514

[45] July 12, 1977

[54] DOOR FRAME STRUCTURE HAVING QUICK MOUNTING HINGE MEANS

[75] Inventor: Eugene F. Cecil, deceased, late of Kewanee, Ill., by Leona Cecil, administratrix

[73] Assignee: United States Gypsum Company, Chicago, Ill.

[21] Appl. No.: 639,538

[22] Filed: Dec. 10, 1975

[51] Int. Cl.[2] ..... E06B 1/04; E06B 9/38

[52] U.S. Cl. ..... 49/504; 52/213; 52/215

[58] Field of Search ..... 52/211, 213–217; 49/399, 400, 504, 505

[56] References Cited

U.S. PATENT DOCUMENTS

| | | | |
|---|---|---|---|
| 1,701,679 | 2/1929 | Johnson | 52/215 |
| 1,731,459 | 10/1929 | Gross | 52/211 |
| 2,742,117 | 4/1956 | Tolman | 52/213 |
| 2,835,933 | 5/1958 | Evans | 52/215 |
| 3,299,592 | 1/1967 | Cable | 52/215 |
| 3,345,780 | 10/1967 | McGhee | 52/213 |
| 3,401,487 | 9/1968 | Brandt et al. | 49/504 |

*Primary Examiner*—Price C. Faw, Jr.
*Assistant Examiner*—James L. Ridgill, Jr.
*Attorney, Agent, or Firm*—Samuel Kurlandsky; Robert H. Robinson; Donnie Rudd

[57] ABSTRACT

A quickly assembled door frame formed of sheet metal and having a generally U-shaped cross-section, one of the frame members being adapted to mount a hinge having a portion embossed to provide a recess to receive a plate of the hinge, a plurality of slots provided in a side wall, and a hinge anchor plate having engagement tabs adapted to be inserted into the slots and having threaded apertures adapted to engage screws engaging the hinge plate and passing through apertures provided in the frame member. In an improved embodiment secondary embossments are provided in the frame member defining alignment channels, and the hinge anchor plate is provided with guide tabs adapted to be received within channels, thereby maintaining the engagement tabs of the hinge anchor plate in engagement with the inner wall of the primary embossment.

15 Claims, 7 Drawing Figures

DOOR FRAME STRUCTURE HAVING QUICK MOUNTING HINGE MEANS

BACKGROUND OF THE INVENTION

1. Field of the Invention

The present invention relates to door frames, and is more particularly concerned with a quickly assembled door frame adapted for use with wall structures formed of gypsum wallboard, and having means for readily mounting hinges for supporting a door.

2. Prior Art

Door frames which may be quickly assembled are known in the art. Frames of this type are disclosed in U.S. Pat. No. 3,469,360 and are formed of sheet metal of channel-form construction. Such frames are designed to be applied over drywall constructions, and are generally provided with legs terminating in U-shaped portions defining recesses, and maintaining the legs of the frame spaced-apart from the wall. Such frames are generally formed having a hinge jamb, a strike jamb and a frame head. Means is provided on the hinge jamb for mounting at least two hinges for hingedly supporting a door. Because the frame members are formed of relatively thin metal, other means must be utilized to support the fastening means such as screws which are used for affixing the hinge. When wood studs are used, it is generally conventional to drive screws into the studs. However, when metal studs are utilized, this means of fastening screws is not satisfactory, since the studs ar generally formed of relatively thin metal and the screws can readily pull out of the studs.

Various means have been utilized for mounting hinges to provide a strong support for the hinge fastening means. U.S. Pat. Nos. 3,721,055 discloses a means of mounting a hinge to a frame comprising a metal channel which is spot welded to the door frame. However, this type of structure is relatively complicated and expensive to produce. Other and simpler structures have not proven to be satisfactory since they do not provide sufficient support for the hinge fastener.

SUMMARY OF THE INVENTION

It is accordingly an object of the present invention to provide a door frame assembly which is readily constructed and mounted.

It is another object of the invention to provide a door frame having means for mounting hinges on one member of the frame.

It is still a further object to provide a hinge mounting means in which the mounted plate of the hinge is recessed within the door frame and has its outer surface substantially flush with the door frame.

It is further an object of the invention to provide a door frame having hinges which are strongly affixed and which structure may be utilized even with wall structures utilizing metal studs.

Still other objects and advantages of the invention will readily present themselves to one skilled in the art upon reference to the following specification, drawings, and the claims.

DESCRIPTION OF THE PREFERRED EMBODIMENT

Figure 1:
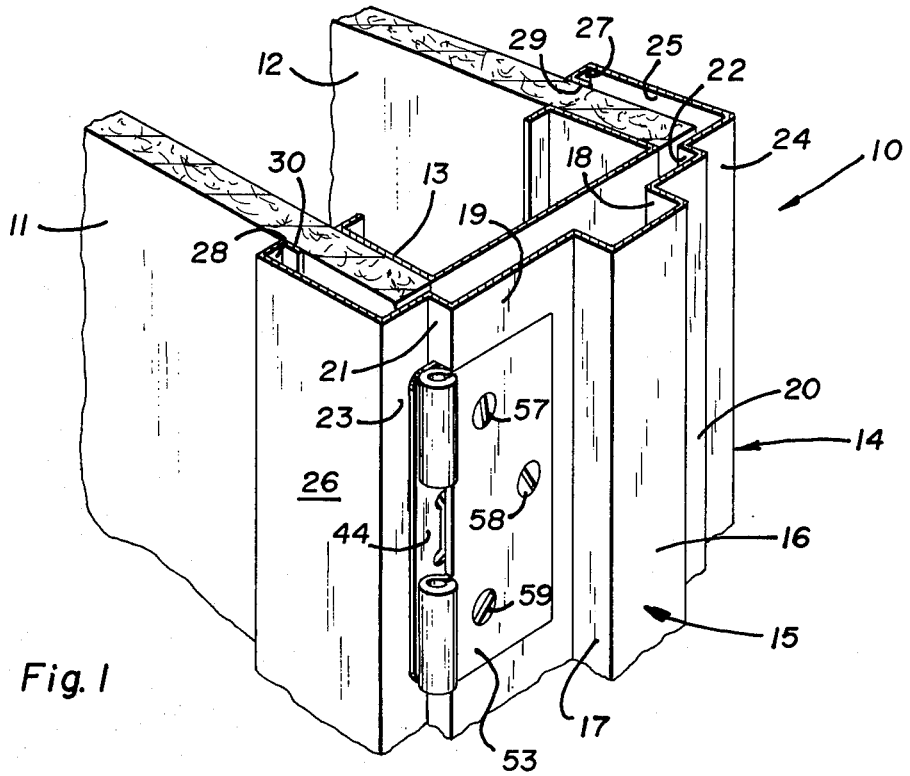
FIG. 1 is a fragmentary perspective view of a portion of a door frame and wall structure according to the invention.
Figure 2:
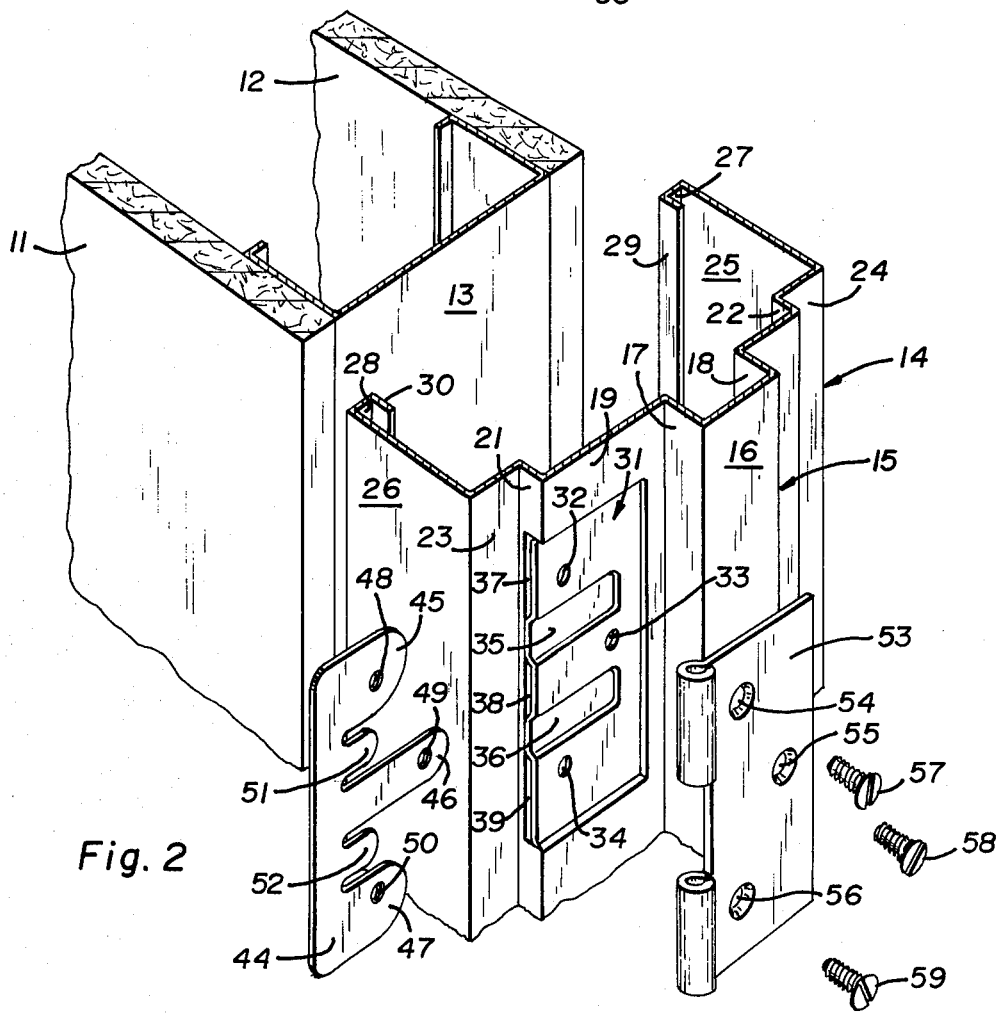
FIG. 2 is an exploded fragmentary perspective view of the wall structure showing the hinge mounting structure in greater detail.

Referring to FIGS. 1 and 2, a wall and door frame structure 10 is shown comprising gypsum wallboard panels 11 and 12 supported by a steel stud 13. A hinge jamb 14 of generally C-shaped cross-section is mounted over the wall structure and comprises a door stop 15 having a front wall 16 and two side walls 17 and 18. A first pair of front wall panels 19 and 20 extend perpendicularly with respect to the side wall 17 and 18. A pair of small secondary side panels 21 and 22 extend substantially perpendicular to the front wall panels 19 and 20, respectively. A pair of secondary front wall panels 23 and 24 extend substantially perpendicularly with respect to the secondary side wall panels 21 and 22, respectively, and main side wall panels 25 and 26 extend substantially perpendicularly with respect to the wall panels 23 and 24. Rear wall panels 27 and 28 extend substantially perpendicularly with respect to the side wall panels 25 and 26 and are provided with wallboard engagement flanges 29 and 30.

Figure 3:
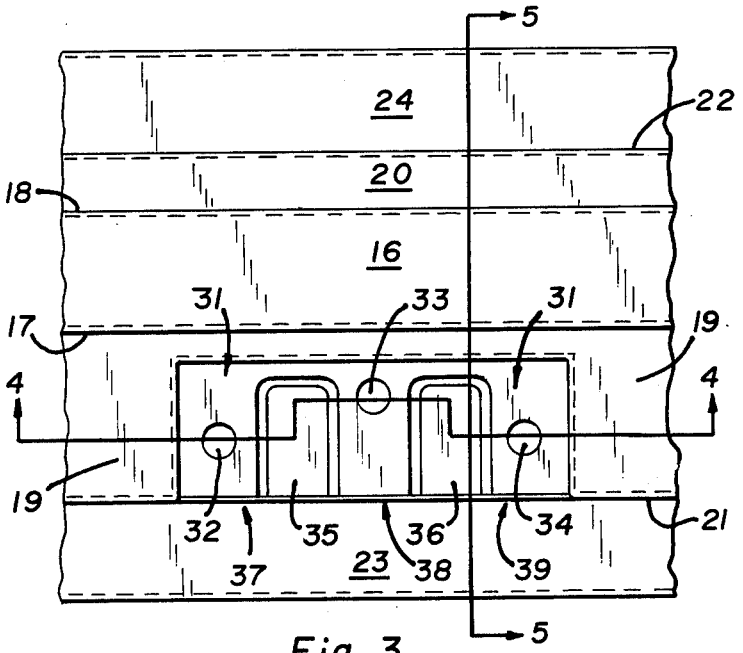
FIG. 3 is a plan view of the hinge jamb according to the invention.
Figure 5:
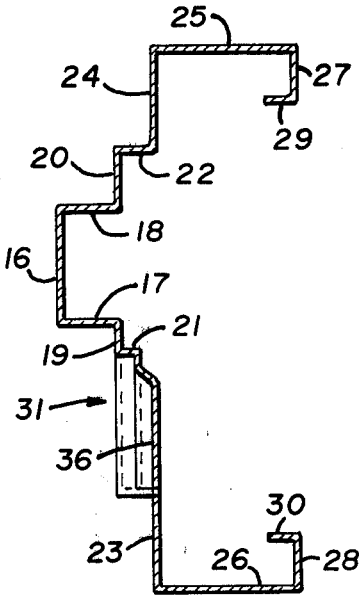
FIG. 5 is a cross-sectional view taken at the line 5—5 of FIG. 3, looking in the direction of the arrows.
Figure 4:
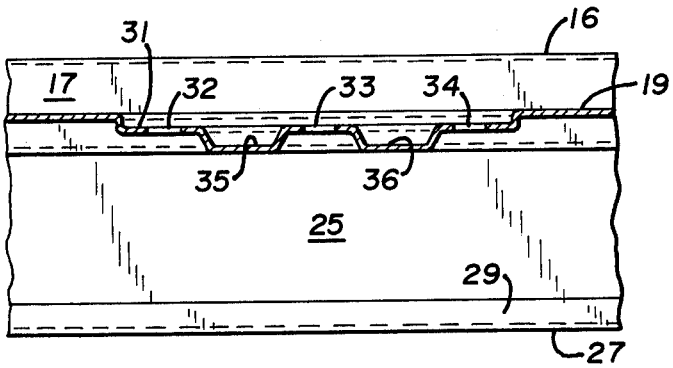
FIG. 4 is a cross-sectional view of the hinge jamb shown in FIG. 3, taken at the line 4—4 of FIG. 3, looking in the direction of the arrows.

As shown particularly in FIG. 2, 3 and 4, the front wall panel 19 is embossed inwardly to provide a hinge-receiving recess 31 which may be of sufficient depth so that the surface of a hinge plate mounts substantially flush with the outer surface of the front wall panel 19. Apertures 32, 33 and 34 are provided to receive hinge attaching screws. The panel 19 is further embossed to provide a pair of alignment channels 35 and 36. Slots 37, 38 and 39 are provided in the secondary side wall panel 21 below the surface of the recessed portion of the panel 19.

Figure 6:
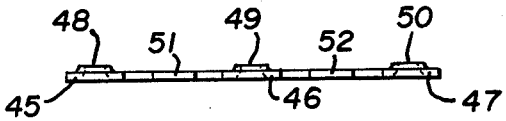
FIG. 6 is a plan view of a hinge anchor plate according to the invention.
Figure 7:
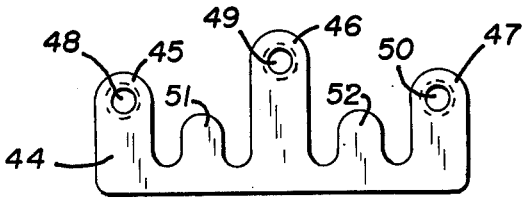
FIG. 7 is an edge view of the structure shown in FIG. 6.

Referring particularly to FIGS. 2, 6 and 7, a hinge anchor plate 44 is shown having three screw engagement tabs 45, 46 and 47 provided with threaded apertures 48, 49 and 50, respectively. The hinge anchor plate 44 is also provided with alignment tabs 51 and 52. Further shown in FIG. 2 is one hinge plate member 53 of a hinge assembly provided with apertures 54, 55 and 56 adapted to receive mounting screws 57, 58 and 59.

In fabricating the hinge jamb of the invention, the jamb is first rolled or otherwise fabricated to form the basic C-shaped structure. Then the hinge-receiving recess 31 and the alignment channels 35 and 36 are embossed inwardly into the front wall panel 19. The slots 37, 38 and 39 are cut into the side wall panel 21, and apertures 32, 33 and 34 cut into the embossed recess 31. These operations may be accomplished at the same time or in separate operations, as dictated by expediency. The hinge anchor plate may be stamped or cut in any conventional manner. The apertures 48, 49 and 50 may be punched, drilled or extruded, and then tapped.

The hinge jamb may be mounted and affixed to a wall either before or after the hinge assembly is applied. To mount the hinge assembly, the hinge anchor plate inserted in place by placing the tabs 45, 46 and 47 into the slots 37, 38 and 39. The anchor plate is pushed toward the jamb to permit the engagement tabs to enter into the space behind the recess 31. The alignment tabs 51 and 52 enter the alignment channels 35 and 36, respectively, and maintain the anchor plate in the proper position, and additionally maintain the tabs 45, 46 and 47 in engagement with the back surface of the hinge-receiving recess 31. The hinge plate 53 is then positioned in the recess 31 and the screws 57, 58 and 59 are inserted through the apertures 54, 55 and 56, respectively, and screw-engaged in the threaded apertures 48, 49 and 50. Since the plate 44 is made of metal thicker and, if desired, stronger than that of which the hinge jamb or metal stud are made, it provides a very strong anchoring of the hinge, without the danger of the screw fasteners being pulled out of the metal.

The hinge support apparatus of the present invention offers several advantages over similar structures utilized in the prior art. First, it provides a neat and attractive recessed hinge plate arrangement. Second, it provides an extremely strong anchoring for the hinge fasteners which is not dependent upon the thickness ot strength of the material of either the jamb or the stud supporting the wallboards. As a result, the structure is equally adaptable for use with wood studs or steel studs. The structure is very easy to assemble and the anchor plate may be readily inserted even after the jamb has been affixed to the wall structure. The use of pretapped apertures in the anchor plate increases the speed and ease with which assembly may be made. The anchor plate is amost completely concealed within the jamb structure after assembly. Further, the parts are readily fabricated and assembled and are relatively inexpensive to use.

It is to be understood that the invention is not to be limited to the exact details of operation or structure shown and described in the specification and drawings, since obvious modifications and equivalents will be readily apparent to one skilled in the art.

What is claimed is:

1. A hinge jamb assembly adapted to be assembled in cooperation with a strike jamb and a horizontal head to form a door frame, comprising:

a. a hinge jamb of generally C-shaped cross-section comprising a channel-form door stop, front wall panels on each side of said door stop substantially perpendicular thereto, and main side wall panels for receiving a wall structure therebetween, the front wall panel on at least one side of said door stop having a secondary side wall panel provided with a plurality of slots therein connected to the front wall panel, and means connecting said secondary side wall panel to said main side wall panel, said front wall panel being embossed inwardly to define a hinge plate-receiving recess having a fastener-receiving aperture therein and being further inwardly embossed to define at least one alignment channel, and b. a hinge anchor plate having a plurality of engagement tabs with fastener-engaging means provided therein adapted to be inserted into the slots of said secondary side wall panel, and at least one alignment tab adapted to be inserted into said alignment channel, whereby a fastener means engaging a hinge plate may be inserted through the aperture in said recess and engaged with the engagement tab of said hinge anchor plate.

2. An assembly according to claim 1, wherein the other front wall is also provided with a secondary side wall and means connecting said secondary side wall to the other of said main side walls.

3. An assembly according to claim 1, wherein said secondary side wall panel is provided with a plurality of spaced-apart slots, said recess is provided with a plurality of apertures, and said hinge anchor plate is provided with a plurality of spaced-apart engagement tabs adapted to be inserted into said slots.

4. An assembly according to claim 3, wherein said recess is provided with a plurality of alignment channels each one intermediate a pair of slots, and said hinge anchor plate is provided with a plurality of alignment tabs one intermediate each pair of engagement tabs, and adapted to be inserted into said alignment channels.

5. An assembly according to claim 4, wherein said fastener means are screws and said engagement tabs are provided with tapped apertures to engage said screws.

6. In combination:

A. a hinge jamb assembly adapted to be assembled in cooperation with a strike jamb and a horizontal head to form a door frame, comprising;

1. a hinge jamb of generally C-shaped cross-section comprising a channel-form door stop, front wall panels on each side of said door stop substantially perpendicular thereto, and main side wall panels for receiving a wall structure therebetween, the front wall panel on at least one side of said door stop having a secondary side wall panel provided with a plurality of slots therein connected to the front wall panel, and means connecting said secondary side wall panel to said main side wall panel, said front wall panel being embossed inwardly to define a hinge plate-receiving recess having a fastener-receiving aperture therein and being further inwardly embossed to define at least one alignment channel, and 2. a hinge anchor plate having a plurality of engagement tabs with fastener-engaging means provided therein inserted into the slots of said secondary side wall panel, and at least one alignment tab inserted into said alignment channel, and B. a hinge plate positioned in said recess having a fastener means disposed through an aperture in said hinge plate and extending through the aperture in said recess and engaged by said engagement tab.

7. A combination according to claim 6, wherein the other front wall is also provided with a secondary side wall and means connecting said secondary side wall to the other of said main side walls.

8. A combination according to claim 6, wherein said secondary side wall panel is provided with a plurality of spaced-apart slots, said recess is provided with a plurality of apertures, and said hinge anchor plate is provided with a plurality of spaced-apart engagement tabs inserted into said slots.

9. A combination according to claim 8, wherein said recess is provided with a plurality of alignment channels each one intermediate a pair of slots, and said hinge anchor plate is provided with a plurality of alignment tabs one intermediate each pair of engagement tabs and inserted into said alignment channels.

10. A combination according to claim 9, wherein said fastener means are screws and said engagement tabs are provided with tapped apertures engaging said screws.

11. A hinge jamb assembly adapted to be assembled in cooperation with a strike jamb and a horizontal head to form a door frame, comprising;

a. a hinge jamb of generally C-shaped cross-section comprising a channel-form door stop, front wall panels on each side of said door stop substantially perpendicular thereto, and main side wall panels for receiving a wall structure therebetween, the front wall panel on at least one side of said door stop having a secondary side wall panel provided with a plurality of slots therein connected to the front wall panel, and means connecting said secondary side wall panel to said main side wall panel, said front wall panel having a fastener-receiving aperture therein and being embossed inwardly to definat least one alignment channel, and b. a hinge anchor plate having a plurality of engagement tabs with fastener-engaging means provided therein adapted to be inserted into the slots of said secondary side wall panel, and at least one alignment tab adapted to be inserted into said alignment channel, whereby a fastener means engaging a hinge plate may be inserted through the aperture in said recess and engaged with the engagement tab of said hinge anchor plate.

12. An assembly according to claim 11, wherein the other front wall is also provided with a secondary side wall and means connecting said secondary side wall to the other of said main side walls.

13. An assembly according to claim 11, wherein said secondary side wall panel is provided with a plurality of spaced-apart slots, said front wall panel is provided with a plurality of apertures, and said hinge anchor plate is provided with a plurality of spaced-apart engagement tabs adapted to be inserted into said slots.

14. An assembly according to claim 13, wherein said front wall panel is provided with a plurality of alignment channels each one intermediate a pair of slots, and said hinge anchor plate is provided with a plurality of alignment tabs one intermediate each pair of engagement tabs, and adapted to be inserted into said alignment channels.

15. An assembly according to claim 14, wherein said fastener means are screws and said engagement tabs are provided with tapped apertures to engage said screws.

* * * * *